US009090423B2

(12) United States Patent
Ishizuka

(10) Patent No.: US 9,090,423 B2
(45) Date of Patent: Jul. 28, 2015

(54) RECORDING APPARATUS AND RECORDING METHOD

(71) Applicant: SEIKO EPSON CORPORATION, Tokyo (JP)

(72) Inventor: Hirotaka Ishizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/160,994

(22) Filed: Jan. 22, 2014

(65) Prior Publication Data

US 2014/0209654 A1 Jul. 31, 2014

(30) Foreign Application Priority Data

Jan. 25, 2013 (JP) ..... 2013-011790
Dec. 5, 2013 (JP) ..... 2013-251776

(51) Int. Cl.

| | |
|---|---|
| ***B65H 23/00*** | (2006.01) |
| ***B65H 23/02*** | (2006.01) |
| ***B41J 3/46*** | (2006.01) |
| ***B41J 11/00*** | (2006.01) |
| ***B65H 20/06*** | (2006.01) |

(52) U.S. Cl.

CPC ..... *B65H 23/0204* (2013.01); *B41J 3/46* (2013.01); *B41J 11/007* (2013.01); *B65H 20/06* (2013.01); *B65H 2404/285* (2013.01)

(58) Field of Classification Search

CPC ..... B65H 2404/285; B65H 23/02; B65H 2301/13; B65H 23/00; B65H 2301/31; B41J 15/046; B41J 15/048; B41J 15/08

USPC ..... 400/619, 629, 583, 611

See application file for complete search history.

(56) References Cited

U.S. PATENT DOCUMENTS

| | | | | |
|---|---|---|---|---|
| 2003/0128253 | A1* | 7/2003 | Kitahara et al. | 347/42 |
| 2003/0142988 | A1* | 7/2003 | Kimura | 399/49 |
| 2006/0181593 | A1* | 8/2006 | Okano | 347/112 |
| 2008/0107461 | A1* | 5/2008 | Miyata et al. | 399/343 |
| 2012/0182347 | A1 | 7/2012 | Shimizu et al. | |

FOREIGN PATENT DOCUMENTS

| | | | |
|---|---|---|---|
| EP | 0687560 | A1 | 12/1995 |
| EP | 0727310 | A1 | 8/1996 |
| JP | 11-192694 | A | 7/1999 |

OTHER PUBLICATIONS

The extended European Search Report for European Application No. 14152321.7 mailed Apr. 24, 2014.

* cited by examiner

*Primary Examiner* — Blake A Tankersley
*Assistant Examiner* — Ruben Parco, Jr.
(74) *Attorney, Agent, or Firm* — Global IP Counselors, LLP

(57) ABSTRACT

A recording apparatus includes a movable belt and a recording mechanism. The movable belt is configured and arranged to convey a recording medium. The recording mechanism is configured and arranged to record onto the recording medium. The movable belt has a mark serving as a reference for when the recording medium is being set thereon.

2 Claims, 6 Drawing Sheets

RECORDING APPARATUS AND RECORDING METHOD

CROSS-REFERENCE TO RELATED APPLICATIONS

This application claims priority to Japanese Patent Application No. 2013-011790 filed on Jan. 25, 2013 and Japanese Patent Application No. 2013-251776 filed on Dec. 5, 2013. The entire disclosures of Japanese Patent Application Nos. 2013-011790 and 2013-251776 are hereby incorporated herein by reference.

BACKGROUND

1. Technical Field

The present invention relates to a recording apparatus provided with a conveyance mechanism for conveying a recording medium set on a movable belt, and to a recording method.

2. Related Art

Recording apparatuses provided with a conveyance mechanism for conveying a recording medium set on a movable belt have been conventionally used. Of such recording apparatuses, there has been much use of recording apparatuses for conveying a recording medium set so as not to move on the movable belt, such as a recording apparatus provided with a conveyance mechanism for conveying a recording medium bonded to a glue belt. For example, Japanese Laid-Open Patent Publication No. 11-192694 discloses a recording apparatus provided with an endless belt for adhesively fixing and conveying a recording medium, and a cleaning section equipped with a wiping roller of which the peripheral surface is composed of a porous polymer body.

SUMMARY

However, in a recording apparatus provided with a conveyance mechanism for conveying a recording medium set on a movable belt, there are some instances where faulty setting of when the recording medium is set on the movable belt causes, inter alia, faulty recording or interference between the recording medium and a recording mechanism or the like.

For example, setting of the recording medium at an incline from a desired direction of setting results in the formation of an image at an incline from the desired direction.

Also, in particular in a recording apparatus for continuously conveying an elongated recording medium placed on a movable belt, there are some instances where, when the recording medium is set at an incline from the desired direction of setting, the recording medium experiences wrinkling or the like and there is interference between the recording medium and a recording mechanism or the like. When there is interference between the recording medium and a recording mechanism or the like, there are some instances where a recording image formed on the recording medium sustains damage, as well as even some instances where the recording medium and/or a recording mechanism or the like sustains damage.

In view whereof, an objective of the present invention is to minimize, inter alia, faulty recording or interference between a recording medium and a recording mechanism or the like caused by faulty setting of when the recording medium is set on a movable belt.

A recording apparatus according to a first aspect includes a movable belt and a recording mechanism. The movable belt is configured and arranged to convey a recording medium. The recording mechanism is configured and arranged to record onto the recording medium. The movable belt has a mark serving as a reference for when the recording medium is being set thereon.

Herein, "a mark serving as a reference for when the recording medium is being set thereon" merely signifies a mark that can serve as a reference for when the recording medium is being set thereon, and is not particularly limited. For example, the mark may be a linear mark, a dotted mark, a lattice of marks, or the like. The mark may be intended for the recording medium to be set therealong, or may be intended for the recording medium to be set by another method.

According to the present aspect, because the movable belt has the mark serving as the reference for when the recording medium is being set thereon, it is possible to minimize faulty setting of when the recording medium is being set on the movable belt. For this reason, it is possible to minimize, inter alia, faulty recording or interference between the recording medium and the recording mechanism caused by such faulty setting.

A recording apparatus of a second aspect of the present invention relates to the first aspect, further including a control unit configured to control the recording mechanism to record the mark onto the movable belt.

According to the present aspect, because the mark serving as the reference for when the recording medium is being set thereon can be recorded by the recording mechanism onto the movable belt, it is possible to minimize faulty setting of when the recording medium is being set on the movable belt. For this reason, it is possible to minimize, inter alia, faulty recording or interference between the recording medium and the recording mechanism caused by such faulty setting.

A recording apparatus of a third aspect of the present invention relates to the first or second aspect, wherein the mark serves as the reference in at least one of a width direction of the recording medium and a direction of conveyance of the recording medium.

According to the present aspect, the mark serves as the reference in the width direction of the recording medium and/or the direction of conveyance of the recording medium. Of these directions, in a case where the mark serves as the reference in the width direction of the recording medium, the mark makes it possible to set the recording medium without being at an incline with respect to the direction of conveyance. In a case where the mark serves as the reference in the direction of conveyance of the recording medium, the mark makes it possible to set the recording medium without deviating with respect to a recording start position.

A recording apparatus of a fourth aspect of the present invention relates to the second or third aspect, further including a user interface configured to enable inputting of a position of recording of the mark on the movable belt. The control unit is configured to control the recording mechanism so as to record the mark at the position of recording inputted by the user interface.

Herein, the "user interface" has a significance also encompassing any device for inputting information and also any device for outputting information; for example, a monitor, keyboard, mouse, button, touch panel, or the like is applicable. For this reason, provided that the position of recording of the mark can be inputted to the "user interface enabling inputting of a position of recording of the mark", a device provided with a plurality of functions enabling inputting and outputting of other information would also be included. Those constituted of a single device are included, as are those constituted of a plurality of devices.

According to the present aspect, the recording apparatus is provided with a user interface enabling inputting of the position of recording. For this reason, a user can easily set the positions of recording.

A recording apparatus of a fifth aspect of the present invention relates to the fourth aspect, wherein the user interface is configured to enable inputting of information about the recording medium, and the control unit is configured to control the recording medium to record the mark at the position of recording established based on the information about the recording medium inputted by the user interface.

Herein, "information about the recording medium" signifies, for example, the length of the recording medium in the width direction, and the like.

According to the present aspect, the user interface enables inputting of information about the recording medium, and the control unit controls the recording medium so as to record the mark at a position of recording established based on information about the recording medium inputted by the user interface. For this reason, the user can set the positions of recording by the simple operation of using the user interface to input the information about the recording medium.

A recording apparatus of a sixth aspect of the present invention relates to the fourth or fifth aspect, wherein the recording mechanism is configured and arranged to record to an outside of the recording medium on the movable belt in the width direction of the recording medium when executing recording onto the recording medium, the user interface is configured to enable inputting of a recording instruction for at least one of a recording execution distance in the direction of conveyance of the recording medium, information about the recording medium, recording conditions, and production information, and the control unit is configured to control the recording mechanism to record a recording instruction content inputted by the user interface on the outside when the recording mechanism is executing recording onto the recording medium.

Herein, "recording conditions" signifies, for example, a recording start position in relation to the recording medium having been set onto the movable belt, a type of recording mode in a case where the recording apparatus has a plurality of recording modes, or the like. "Production information" signifies, for example, the name of the person requested the recorded material, or the like.

According to the present aspect, it is possible to record, to the outside, at least one from among a recording execution distance in the direction of conveyance of the recording medium, information about the recording medium, recording conditions, and production information, when the recording is being executed onto the recording medium. For this reason, when the recording is being executed onto the recording medium, the user is able to confirm the positional information in the direction of conveyance for a case where faulty recording has taken place, to confirm that desired recording has been carried out, and the like.

A recording apparatus of a seventh aspect of the present invention relates to any of the first through sixth aspects, wherein the movable belt is a glue belt.

In a recording apparatus having a glue belt (a belt that is coated with an adhesive by which the recording medium is detachably adhered to and retained by a surface for setting the recording medium) as a movable belt, the recording medium can be stably supported, and therefore the glue belt is preferably used as a movable belt.

According to the present aspect, it is possible to improve image quality of a recorded image, by making it possible to stably support the recording medium.

Also, in a recording apparatus provided with a glue belt, the recording medium is bonded to the glue belt and therefore wrinkling or the like that takes place with faulty setting is less readily self-repaired, but according to the present aspect, it is possible to suppress faulty setting and possible to effective suppress, inter alia, interference between the recording medium and the recording mechanism or the like.

A recording method according to an eighth aspect is a method for using a recording apparatus having a movable belt configured and arranged to convey a recording medium, and a recording mechanism configured and arranged to record onto the recording medium. The recording method includes: recording, onto the movable belt, a mark serving as a reference for when the recording medium is being set on the movable belt; and executing recording on the recording medium set onto the movable belt using the mark as the reference.

According to the present aspect, because the mark serving as a reference for when the recording medium is being set thereon can be recorded, it is possible to minimize faulty setting of when the recording medium is being set on the movable belt. For this reason, it is possible to minimize, inter alia, faulty recording or interference between the recording medium and the recording mechanism caused by such faulty setting.

BRIEF DESCRIPTION OF THE DRAWINGS

Referring now to the attached drawings which form a part of this original disclosure.

DETAILED DESCRIPTION OF EXEMPLARY EMBODIMENTS

Embodiment of Recording Apparatus (FIGS. 1 to 5)

A recording device as in an embodiment of the present invention shall be described in greater detail below, with reference to the accompanying drawings.

First, a recording apparatus as in an embodiment 1 of the present invention shall be described. The recording apparatus of the present embodiment is a recording apparatus of a configuration provided with a glue belt, as a movable belt. There is, however, no limitation to the configuration of such description.

Figure 1:
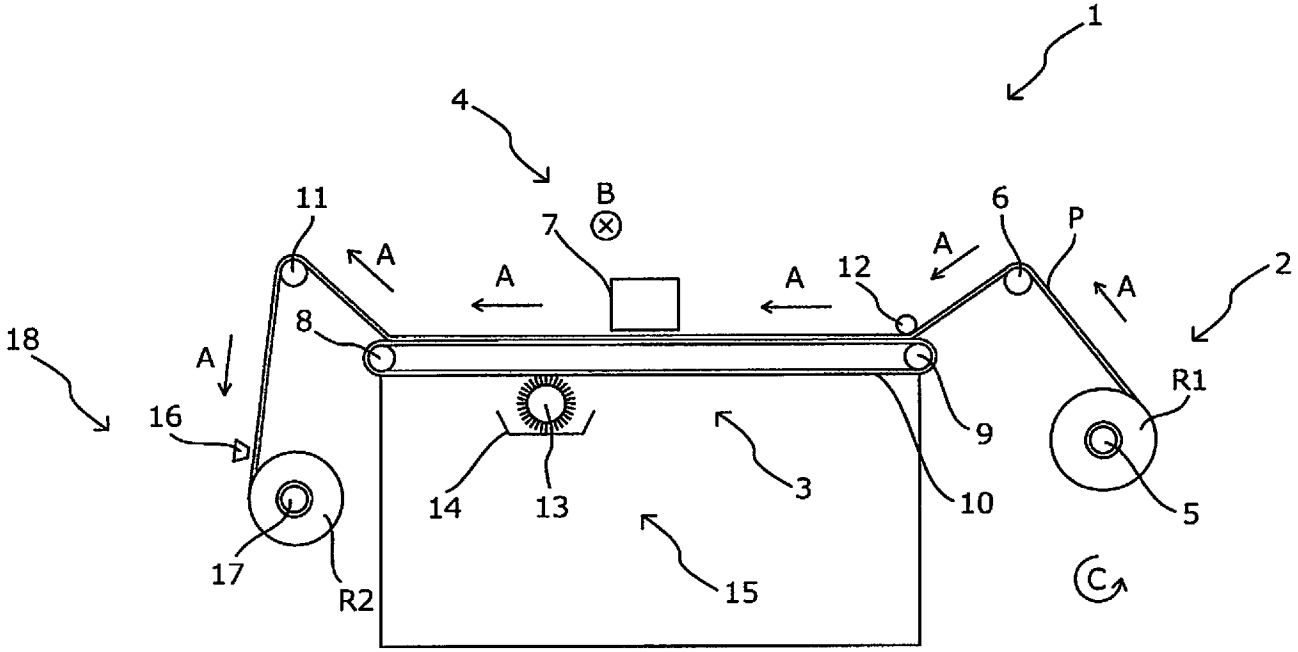
FIG. 1 is a schematic side view representing an embodiment of a recording apparatus of the present invention.

FIG. 1 is a schematic side view of a recording apparatus 1 as in the embodiment 1 of the present invention.

The recording apparatus 1 of the present embodiment is provided with a set section 2 by which a roll R1 of a recording medium P for carrying out recording can be fed out. The recording apparatus 1 is also provided with a conveyance mechanism 3 for conveying the recording medium P in a direction of conveyance A, using a glue belt 10, which is a movable belt. The recording apparatus 1 is further provided with a recording mechanism 4 for recording by reciprocatingly scanning a recording head 7 in a direction of scanning B that intersects with the direction of conveyance A of the recording medium P. The recording apparatus 1 is moreover provided with a cleaning mechanism 15 for cleaning the glue belt 10. The recording apparatus 1 is additionally provided with a take-up mechanism 18 including a take-up spindle 17 for taking up the recording medium P and a cutter 16 for cutting the recording medium P being taken up.

The set section 2 is provided with a rotating shaft 5 doubling as a setting position of the roll R1 of the recording medium P for carrying out recording, and is configured so that the recording medium P can be fed out to the conveyance mechanism 3 via a driven roller 6 from the roll R1 that has been set onto the rotating shaft 5. When the recording medium P is being fed out to the conveyance mechanism 3, the rotating shaft 5 rotates in a direction of rotation C.

The conveyance mechanism 3 is provided with: the glue belt 10, for conveying the recording medium P placed thereon having been fed out from the set section 2; and a conveyance roller 8 and driven roller 9 for moving the glue belt 10. Pressed against the adhesive belt 10 by a pressure roller 12, the recording medium P is thereby stuck to and placed on the glue belt 10. When the recording medium P is being conveyed, the conveyance roller 8 rotates in the direction of rotation C.

The recording mechanism 4 has the recording head 7, a carriage (not shown) loaded with the recording head 7, and a carriage motor 26 (see FIG. 2) for reciprocatingly moving the carriage in the direction of scanning B. In FIG. 1, the direction of scanning B is the direction perpendicular to the plane of the paper.

Recording involves recording by reciprocatingly scanning the recording head 7, where the conveyance mechanism 3 stops the conveyance of the recording medium P during the recording and scanning (during movement of the recording head). Expressed differently, recording involves alternating between reciprocating scanning of the recording head 7 and conveyance of the recording medium P. That is to say, during recording, the conveyance mechanism 3 intermittently conveys the recording medium P so as to correspond with the reciprocating scanning of the recording head 7. The recording apparatus 1 of the present embodiment is provided with the recording mechanism 4 of the configuration of such description, but is not limited to the configuration of such description, and, for example, may be of a configuration provided with a recording mechanism having a line head.

The cleaning mechanism 15 for cleaning the glue belt 10 includes a cleaning unit 13 configured by coupling a plurality of cleaning rollers together in a rotating shaft direction, and a tray 14 in which is placed a cleaning agent serving as a cleaning mechanism of the cleaning unit 13.

The take-up mechanism 18 is a mechanism for taking up the recording medium P onto which recording has been done and which has been conveyed from the conveyance mechanism 3 via the driven roller 11; by being wound around a paper tube for take-up or the like that has been set onto the take-up spindle 17, the recording medium P can be taken up as a roll R2 of the recording medium P.

The electrical configuration in the recording apparatus 1 of the present embodiment shall be described next.

Figure 2:
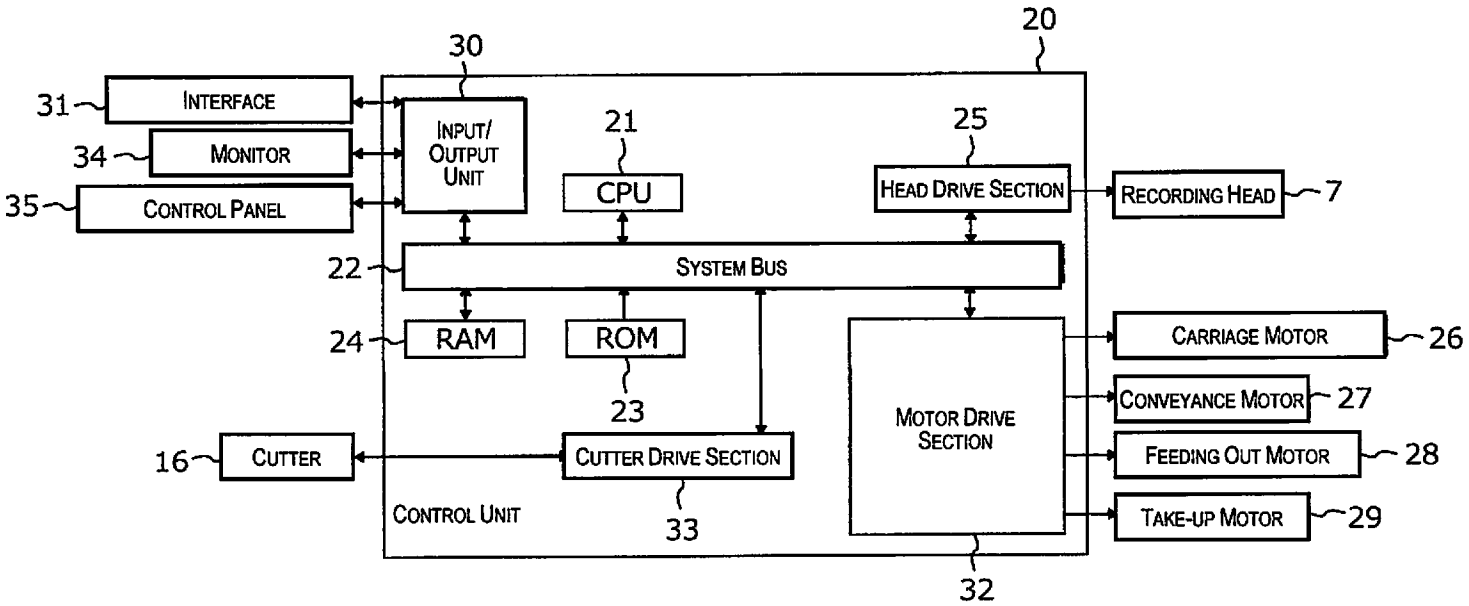
FIG. 2 is a block diagram representing an embodiment of a recording apparatus of the present invention.

FIG. 2 is a block diagram of the recording apparatus 1 of the present embodiment.

A CPU 21 that governs the control of the entirety of the recording device 1 is provided to a control unit 20. The CPU 21 is connected over a system bus 22 to a ROM 23 that stores a variety of control programs executed by the CPU 21 and the like, and to a RAM 24 in which data can be temporarily stored. The CPU 21 is also connected over the system bus 22 to a head drive section 25 for driving the recording head 7.

The CPU 21 is further connected over the system bus 22 to a motor drive section 32 for causing driving by the carriage motor 26, by a conveyance motor 27, a by feeding-out motor 28, and by a turret motor 29.

Here, the carriage motor 26 is a motor for moving the carriage onto which the recording head 7 has been loaded. The conveyance motor 27 is a motor for driving the conveyance roller 8. The feeding-out motor 28 is a rotational mechanism of the rotating shaft 5, and is a motor for driving the rotating shaft 5 in order to feed the recording medium P out to the conveyance mechanism 3. The take-up motor 29 is a drive motor for causing the take-up spindle 17 to rotate.

The CPU 21 is also connected over the system bus 22 to a cutter drive section 33 for driving the cutter 16 so as to cut the recording medium P.

The CPU 21 is, moreover, connected over the system bus 22 to: a monitor 34 and control panel 35 provided to the recording apparatus 1; an interface 31 for, inter alia, inputting recording data and the like from an external apparatus such as a PC or the like; and an input/output unit 30 for transmitting and receiving data and signals.

The monitor 34 of the present embodiment has not only a display function but also a touch panel function, and has the role of a user interface enabling the inputting of the positions of reference marks serving as references for when the recording medium P is being set on the glue belt 10, and the like.

Next, the reference marks serving as references for when the recording medium P undergoing recording is being set on the glue belt 10 in the recording apparatus 1 of the present embodiment shall be described.

Figure 3:
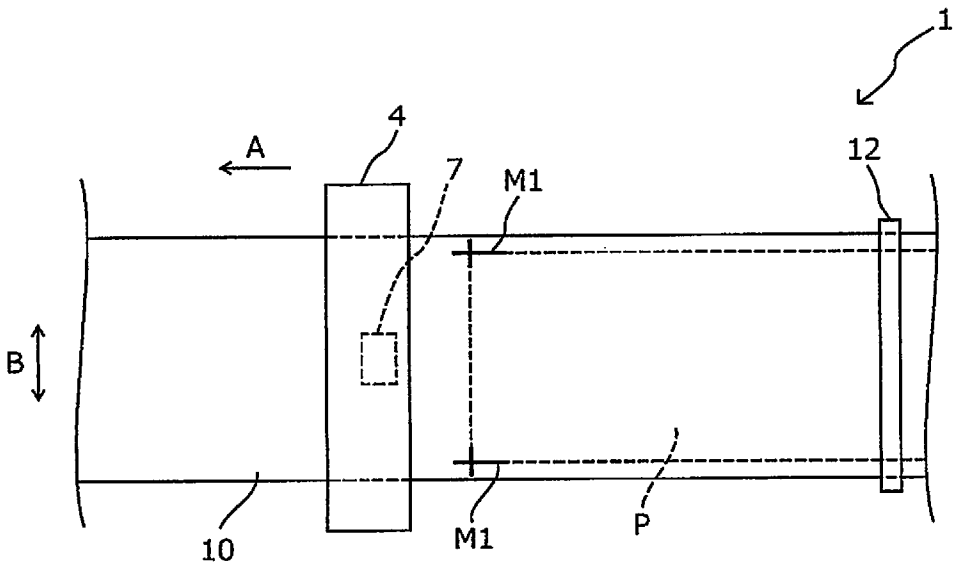
FIG. 3 is a schematic view representing an example of marks for reference marks by a recording apparatus of the present invention.

FIG. 3 is a schematic view of an example of marks for the reference marks by the recording apparatus 1 of the present embodiment, and represents marks M1 recording onto the glue belt 10 and positions of bonding of the recording medium P with respect to the marks M1.

In the recording apparatus 1 of the present embodiment, the control unit 20 controls the recording mechanism 4 so as to record, onto the glue belt 10, the marks M1 serving as reference marks for when the recording medium P is being set on the glue belt 10. FIG. 3 illustrates a state where the marks M1 are recorded by the control of the control unit, and portions where the marks M1 are attached are moved in a direction inverse to the direction of conveyance A. The recording medium P is set at the positions illustrated by the dashed lines. The setting of the recording medium P with reference to the marks M1 can be carried out in a state where the portions where the marks M1 are attached are moved further in the direction inverse to the direction of conveyance A, and the portions where the marks M1 are attached are present in the vicinity of the pressure roller 12.

The marks M1 of the present embodiment are constituted of two orthogonal straight lines composed of lines in directions running respectively along the direction of conveyance A and the direction of scanning B. Having a leading end and side ends of the recording medium P run along each of the straight lines makes it possible for the marks M1 to be references in both the width direction of the recording medium P (in the present embodiment, the same direction as the direction of scanning B) and the direction of conveyance A of the recording medium. There is, however, no limitation to the reference marks of such description. The marks M1 may be references in the width direction of the recording medium P and/or the direction of conveyance of the recording medium P, and may be marks that can serve as references in the setting of the recording medium P on the movable belt, from another perspective.

Figure 4:
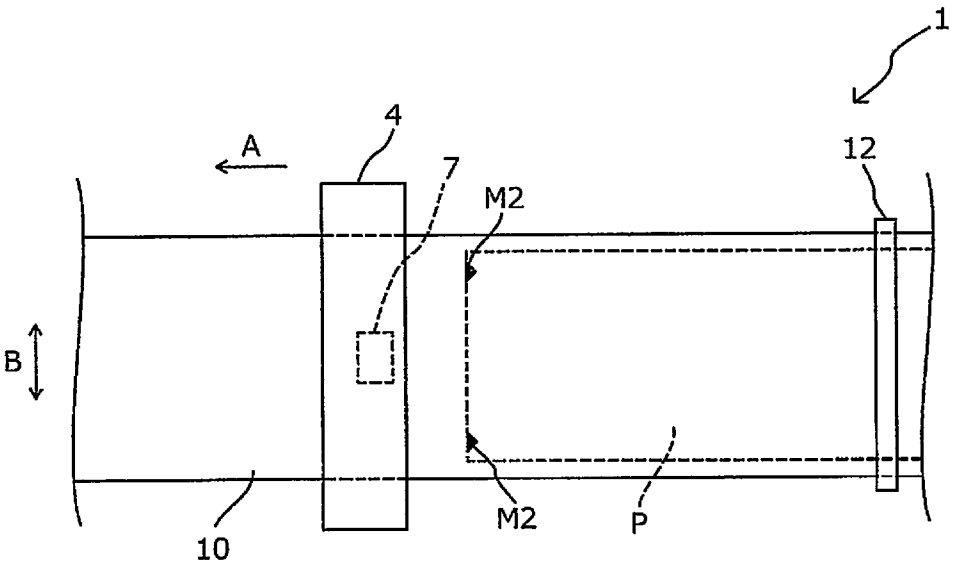
FIG. 4 is a schematic view representing a separate example of marks for reference marks by a recording apparatus of the present invention.

FIG. 4 is a schematic view representing a separate example of marks for the reference marks by the recording apparatus 1 of the present embodiment, and represents marks M2 recorded on the glue belt 10 and positions of bonding of the recording medium P with respect to the marks M2.

The marks M2 are marks that form triangles and can serve as references in the direction of conveyance A of the conveyance medium P, by running the leading end of the recording medium P along one side thereof.

Next, a display screen of the monitor 34, which is a user interface, in the recording apparatus 1 of the present embodiment shall now be described.

Figure 5:
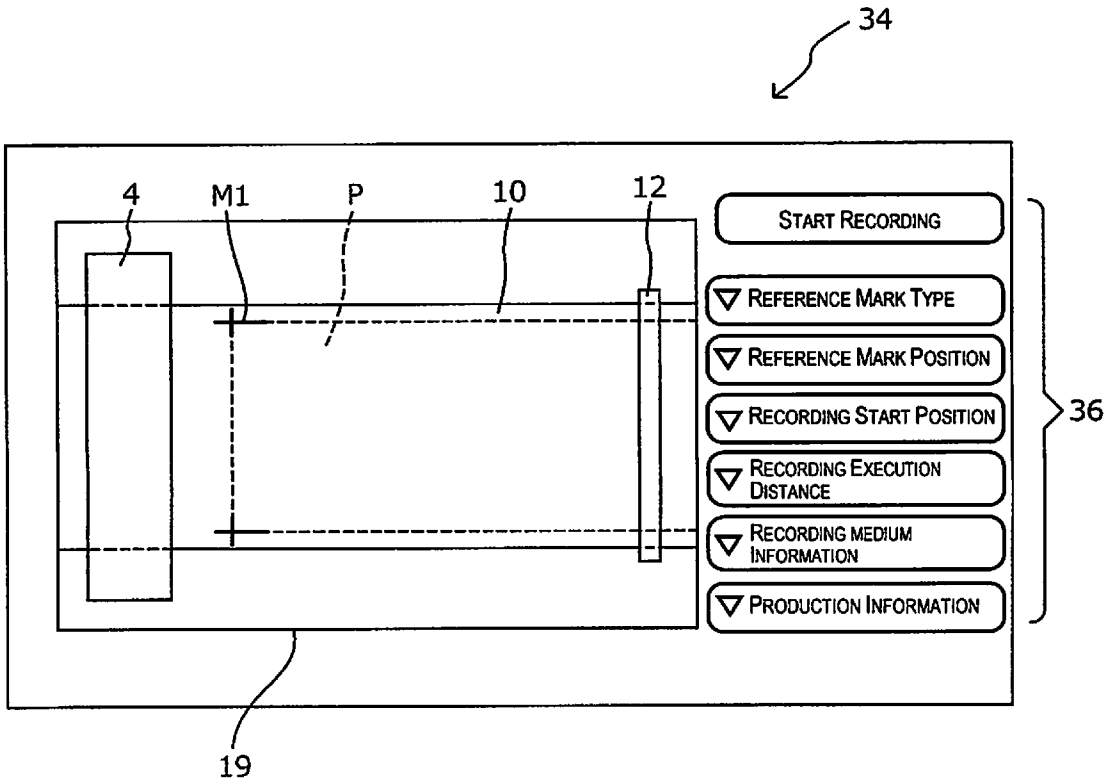
FIG. 5 is a schematic view representing a display screen of a user interface in an embodiment of a recording apparatus of the present invention.

FIG. 5 is a schematic view representing the display screen of the monitor 34, which is a user interface, in the recording apparatus 1 of the present embodiment.

The monitor 34 displays a display section 19 for displaying the recording apparatus 1, and a button section 36 in which a plurality of touch-panel buttons serving as input units for a variety of types of information for instructing recording are displayed. The display section displays a plan view of the recording apparatus 1, and displays the recording mechanism 4, the reference marks serving as references for the setting of the recording medium P onto the glue belt 10, and the like. The button section 36 displays a recording start button, as well as a button with which a variety of pull-down menus make it possible to select a reference mark type as recording instruction content, reference mark positions (the positions of recording of the reference marks with respect to the glue belt 10), a recording start position, a recording execution distance, recording medium information, and production information.

The button section 36 allows the user, while checking with the display section 19, to select the reference mark type, set the reference mark positions and recording start position, set the presence or absence of recording of the recording execution distance, recording medium information, and production information, as well as content thereof, and the like. Expressed differently, the user is able to input such recording instructions while also checking with the display section 19. Then, when the user enters desired settings or the like and presses the recording start button, the reference marks are recorded onto the glue belt 10. FIG. 5 represents a state where the marks M1 have been selected as the type of reference mark.

In the recording apparatus 1 of the present embodiment, the recording execution distance, recording medium information, and production information are recorded to the outside of the recording medium P on the glue belt 10 in the width direction of the recording medium P when a desired image is being recorded onto the recording medium P. The control for so doing is carried out by the control unit 20.

Also, with the recording apparatus 1 of the present embodiment, selecting the width of the recording medium P as the recording medium information allows the user to have the reference mark positions be automatically set from the selected width of the recording medium P, without having to make a separate setting for the reference mark positions. Expressed differently, the monitor 34 enables the inputting of information about the recording medium P, and the control unit 20 controls the recording mechanism 4 so as to record the reference marks at the positions of recording established based on the information about the recording medium P inputted using the monitor 34. For this reason, the simple operation of inputting information about the recording medium P enables the user to set the positions of the reference marks.

Figure 6:
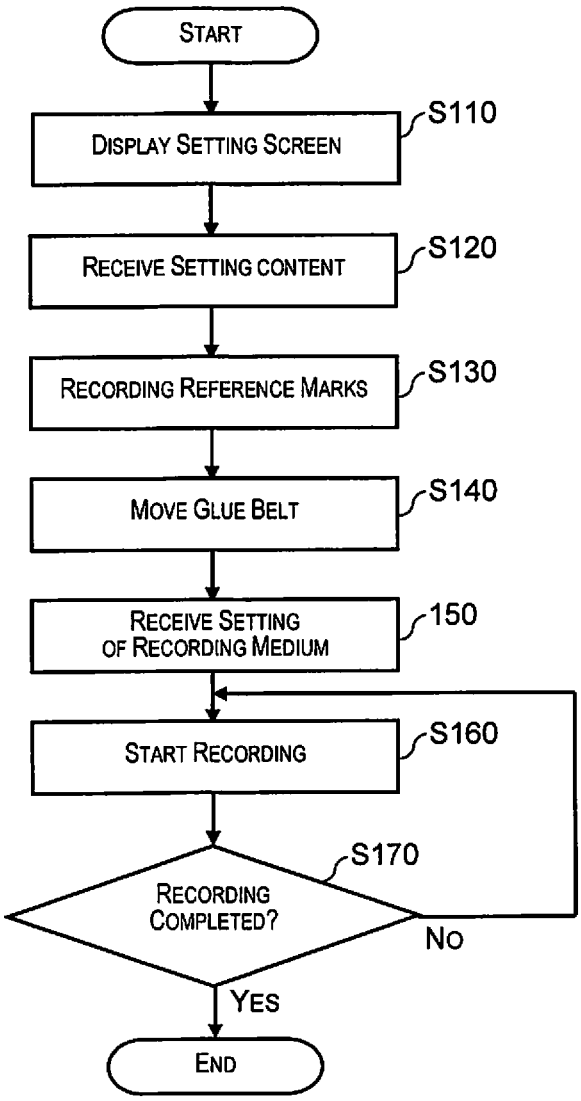
FIG. 6 is a flow chart representing an embodiment of a recording method of the present invention.

Embodiment of a Recording Method (FIG. 6)

Next, the recording method of the present embodiment shall now be described.

FIG. 6 is a flow chart representing the recording method of the present embodiment.

The recording method of the present embodiment is an embodiment that is carried out using the recording apparatus 1 of the embodiment 1.

In the recording method of the present embodiment, first, in step S110, the monitor 34 displays the display screen represented in FIG. 5, and causes the user to set the type of reference marks, positions of recording, or the like.

Next, in step S120, the control unit 20 receives the setting content set by the user using the monitor 34.

Next, in step S130, the control unit 20 controls the recording mechanism 4 and thereby records the reference marks onto the glue belt 10 in accordance with the setting content received in step S120.

Next, in step S140, the glue belt 10 is moved in the direction opposite to the direction of conveyance A, so that the reference marks come close to the pressure roller 12. This enables setting of the recording medium P with reference to the reference marks, by the user.

Next, in step S150, the control unit 20 receives that the user has set the recording medium P onto the glue belt 10. The receiving of the setting of the recording medium P may, for example, comprise coordinately rendering the pressure roller 12 movable and setting the pressure roller 12 at a position of pressing on the recording medium P.

Next, in step S160, recording is started based on the recording data inputted to the recording apparatus 1. Any settings for recording the recording execution distance, the recording medium information, and the production information, when received in step S120, are also recorded to the outside of the recording medium P on the glue belt 10 in the width direction of the recording medium P.

In step S170, the control unit 20 determines whether or not the recording of the recording data inputted to the recording apparatus 1 has been completed. In a case where, in this step, recording is determined not to have been completed, then recording is executed by repeating steps S160 and S170 until recording is determined to have been completed; in a case where recording is determined to have been completed, then the recording method as in the present embodiment is completed.

In the recording apparatus 1 of the embodiment above and the recording method of the embodiment above, the marks M1 or marks M2 serving as references were recorded by the recording mechanism 4, following which the glue belt 10 was moved in the direction opposite to the direction of conveyance A and thereafter the recording medium P was set thereon, but there is no limitation thereto, and a similar effect could still be obtained when the marks M1 or marks M2 serving as references are recorded by the recording mechanism 4, following which the glue belt 10 is moved in the direction of conveyance A to reach a state where the portions at which the marks M1 or marks M2 are attached are present at the positions where the recording medium P can be set.

Also, in the recording apparatus 1 of the embodiment above and the recording method of the embodiment above, the marks M1 or marks M2 serving as references were recorded by the recording mechanism 4, but there is no limitation thereto, and a similar effect could still be obtained by causing the glue belt 10 to have the marks M1 or marks M2, such as by having previously attached the marks M1 or marks M2 serving as the necessary references to the glue belt 10 with a method other than the recording mechanism 4.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording method for using a recording apparatus having a movable belt configured and arranged to convey a recording medium, and a recording mechanism configured and arranged to record onto the recording medium, the recording method comprising:

recording, onto the movable belt, a mark indicative of an initial position of the recording medium relative to the movable belt such that the recording medium is initially set on the movable belt relative to the mark;

moving the movable belt in a direction opposite to a direction of conveyance of the recording medium such that the mark is located upstream relative to the recording mechanism in the direction of conveyance of the recording medium in response to recording the mark on the movable belt; and executing recording on the recording medium set onto the movable belt using the mark as a reference.

2. The recording method according to claim 1, further comprising setting the recording medium onto the movable belt relative to the mark in response to recording the mark on the movable belt.

* * * * *